US009175904B2

(12) United States Patent
Allard et al.

(10) Patent No.: US 9,175,904 B2
(45) Date of Patent: Nov. 3, 2015

(54) CHILLING DEVICE FOR A DOMESTIC REFRIGERATOR

(75) Inventors: Paul B. Allard, Stevensville, MI (US); Douglas D. Leclear, Benton Harbor, MI (US); Karen J. Querfurth, Coloma, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 13/590,221

(22) Filed: Aug. 21, 2012

(65) Prior Publication Data

US 2014/0053592 A1 Feb. 27, 2014

(51) Int. Cl.

| | |
|---|---|
| ***F25D 25/02*** | (2006.01) |
| ***F25D 25/00*** | (2006.01) |
| ***F25D 31/00*** | (2006.01) |

(52) U.S. Cl.

CPC ..... *F25D 25/025* (2013.01); *F25D 25/00* (2013.01); *F25D 31/007* (2013.01); *F25D 2331/805* (2013.01); *F25D 2400/28* (2013.01)

(58) Field of Classification Search

CPC ..... F25D 17/00; F25D 17/062; F25D 17/065; F25D 23/12; F25D 31/007; F25D 2331/803; F25D 2331/805; F25D 2400/28; F25D 2400/30

USPC ..... 312/404, 319.5, 319.7, 298, 301–303, 312/309, 348.3; 211/151; 62/465, 521, 382; 248/240

See application file for complete search history.

(56) References Cited

U.S. PATENT DOCUMENTS

| | | | | |
|---|---|---|---|---|
| 3,203,199 | A * | 8/1965 | Stewart | 62/414 |
| 4,093,055 | A * | 6/1978 | Blackburn et al. | 192/116.5 |
| 4,139,992 | A * | 2/1979 | Fraser | 62/345 |
| 4,326,390 | A * | 4/1982 | Brooks | 62/382 |
| 4,549,409 | A * | 10/1985 | Smith | 62/381 |
| 5,156,008 | A * | 10/1992 | Olsson et al. | 62/63 |
| 5,212,962 | A * | 5/1993 | Kang et al. | 62/382 |
| 5,499,872 | A | 3/1996 | Baxter | |
| 5,593,228 | A | 1/1997 | Tannenbaum | |
| 5,902,618 | A * | 5/1999 | Haasis, Jr. | 426/113 |
| 5,918,979 | A | 7/1999 | Martin et al. | |
| 6,314,751 | B1 * | 11/2001 | Gjersvik | 62/457.4 |
| 6,662,574 | B2 * | 12/2003 | Loibl et al. | 62/64 |

(Continued)

FOREIGN PATENT DOCUMENTS

| | | | | |
|---|---|---|---|---|
| JP | 2006200786 A | * | 8/2006 | F25D 11/00 |
| KR | 20010048305 A | * | 11/1999 | F25D 23/00 |

(Continued)

OTHER PUBLICATIONS

Shaker, www.tradeKorea.com/product-detail/P00027905/Shaker. Categories: Chemicals, Lab Supplies, Other Lab Supplies. Keywords: elimination noise, elimination vibration, shaker. By Jeio Tech Co., Ltd.

*Primary Examiner* — Daniel J Troy
*Assistant Examiner* — Andrew Roersma

(57) ABSTRACT

A refrigerator includes a cabinet having a refrigerated compartment defined therein, a motor coupled to the cabinet, and a chilling device sized to receive a food container. The chilling device is moveable between an engaged positioned in which the chilling device is spaced apart from a drive shaft of the motor and a disengaged position the chilling device is coupled to the drive shaft. The drive shaft is configured to operate the chilling device.

13 Claims, 7 Drawing Sheets

(56) References Cited

U.S. PATENT DOCUMENTS

| | | | | |
|---|---|---|---|---|
| 6,880,949 | B2 | 4/2005 | Miozza et al. | |
| 6,946,242 | B2 * | 9/2005 | Looney | 435/2 |
| 7,197,888 | B2 | 4/2007 | LeClear et al. | |
| 7,343,748 | B2 * | 3/2008 | Freesmeier et al. | 62/62 |
| 7,604,392 | B2 | 10/2009 | Brezinsky et al. | |
| 7,663,331 | B2 * | 2/2010 | Zhuang | 318/558 |
| 7,673,761 | B2 * | 3/2010 | Lee et al. | 211/183 |
| 2003/0081499 | A1 * | 5/2003 | Friedman | 366/208 |
| 2005/0133531 | A1 | 6/2005 | Crisp et al. | |
| 2006/0185372 | A1 * | 8/2006 | Conde Hinojosa | 62/64 |
| 2007/0262686 | A1 | 11/2007 | Ji | |
| 2010/0090575 | A1 | 4/2010 | Uthuppan | |
| 2010/0168920 | A1 | 7/2010 | Hooker et al. | |
| 2012/0011885 | A1 * | 1/2012 | Cho et al. | 62/426 |

FOREIGN PATENT DOCUMENTS

| | | | | | |
|---|---|---|---|---|---|
| KR | 100377751 | B1 * | 3/2003 | | F25D 11/00 |
| KR | 1020050041036 | A * | 4/2005 | | D25D 3/12 |
| KR | 100569892 | B1 * | 4/2006 | | F25D 3/12 |
| KR | 2009075271 | A | 7/2009 | | |
| WO | WO 03070027 | A1 * | 8/2003 | | A23L 3/36 |
| WO | WO 2010076156 | A1 * | 7/2010 | | F25D 31/00 |

* cited by examiner

CHILLING DEVICE FOR A DOMESTIC REFRIGERATOR

TECHNICAL FIELD

The present disclosure relates generally to a domestic refrigerator and more particularly to a chilling device for a domestic refrigerator.

BACKGROUND

A domestic refrigerator is a device that is used to store food items in a home. Domestic refrigerators typically include crisper bins, shelves, and other structures in which food items may be placed. Some food items stored in refrigerators may require special care or handling to ensure those food items are preserved for later use.

SUMMARY

According to one aspect of the disclosure, a refrigerator includes a cabinet having a refrigerated compartment defined therein and a motor coupled to the cabinet, the motor having a drive shaft that extends into the refrigerated compartment. The refrigerator also includes a drawer positioned in the refrigerated compartment, the drawer having a storage chamber defined therein. The refrigerator further includes a chilling device positioned in the storage chamber of the drawer, the chilling device being sized to receive a food container. The drawer is moveable between an open position, in which user access to the storage chamber is permitted and the chilling device is spaced apart from the drive shaft, and a closed position, in which user access to the storage chamber is prevented and the chilling device is coupled to the drive shaft. The drive shaft is configured to operate the chilling device when the drawer is in the closed position.

In some embodiments, the chilling device may include a coupler configured to engage with the drive shaft when the drawer is in the closed position.

In some embodiments, the coupler may include a first body having a vertically-extending surface and a plurality of teeth extending outwardly from the vertically-extending surface. The coupler may further include a second body secured to the drive shaft, the second body having a vertically-extending surface that faces the vertically-extending surface of the first body and a plurality of teeth that may engage the plurality of teeth of the first body when the drawer is in the closed position.

In some embodiments, the drawer may include a bottom wall and a plurality of side walls that define the storage chamber. The chilling device may include a support shaft pivotally coupled to a first side wall of the plurality of side walls. The drive shaft may be engaged with the support shaft to rotate the support shaft about a longitudinal axis when the drawer is in the closed position.

In some embodiments, the support shaft of the chilling device may be a first support shaft. The chilling device may further include a second support shaft extending parallel to the first support shaft. The first support shaft and the second support shaft may cooperate to rotate the food container when the first support shaft is rotated about the longitudinal axis.

In some embodiments, the chilling device may include a plurality of rollers that are coupled to the first support shaft, each roller being configured to engage the food container.

In some embodiments, the plurality of rollers of the chilling device may be a first plurality of rollers. The chilling device may include a second plurality of rollers that are coupled to the second support shaft, each roller being configured to engage the food container.

In some embodiments, the first plurality of rollers and the second plurality of rollers may define a carrier slot sized to receive the food container.

In some embodiments, the chilling device may include a plurality of cams that are coupled to the support shaft.

In some embodiments, the chilling device may include a support arm extending from the first side wall of the drawer. The chilling device may further include a plate defining a storage tray sized to receive the food container, the plate having a first end pivotally coupled to the support arm and a second end in contact with the plurality of cams of the support shaft.

In some embodiments, the plurality of cams may raise and lower the second end of the plate when the support shaft is rotated about the longitudinal axis.

According to another aspect of the disclosure, a refrigerator includes a motor secured to the housing of the refrigerator and a frame moveably coupled to the housing. The refrigerator also includes a first shaft pivotally coupled to the frame. The refrigerator further includes a second shaft pivotally coupled to the frame, the second shaft being spaced apart from and extending parallel to the first shaft to define a carrier slot sized to receive a food container. The frame is moveable between a first position, in which the first shaft is connected to the motor, and a second position, in which the first shaft is spaced apart from the motor.

In some embodiments, the chilling device may include a plurality of rollers that are coupled to the first shaft, each roller being configured to engage the food container.

In some embodiments, the frame may be a drawer having a storage chamber defined therein.

In some embodiments, the motor may include a drive shaft having a first plurality of teeth formed thereon. The first shaft may have a second plurality of teeth formed thereon. The second plurality of teeth may be engaged with the first plurality of teeth when the frame is in the first position and spaced apart from the first plurality of teeth when the frame is in the second position.

According to another aspect of the disclosure, a chilling device for a refrigerator includes a motor secured to a housing of the refrigerator and a frame moveably coupled to the housing. The chilling device also includes a shaft pivotally coupled to the frame, the shaft having a plurality of cams coupled to it. The chilling device further includes a plate defining a storage tray sized to receive a food container, the plate having a first end pivotally coupled to the frame and a second end engaged with the plurality of cams. The frame is moveable between a first position, in which the shaft is connected to the motor, and a second position, in which the shaft is spaced apart from the motor.

In some embodiments, the frame may include a support arm extending parallel to the shaft. The first end of the plate may be pivotally coupled to the support arm.

In some embodiments, the frame may be a drawer having a storage chamber defined therein.

In some embodiments, the motor may include a drive shaft having a first plurality of teeth formed thereon. The shaft may have a second plurality of teeth formed thereon. The second plurality of teeth may be engaged with the first plurality of teeth when the frame is in the first position and spaced apart from the first plurality of teeth when the frame is in the second position.

In some embodiments, the motor may be operable to rotate the shaft about a longitudinal axis when the shaft is connected to the motor. The plurality of cams may raise and lower the second end of the plate when the shaft is rotated about the longitudinal axis.

BRIEF DESCRIPTION OF THE DRAWINGS

The detailed description particularly refers to the following figures, in which.

DETAILED DESCRIPTION OF THE DRAWINGS

Figure 1:
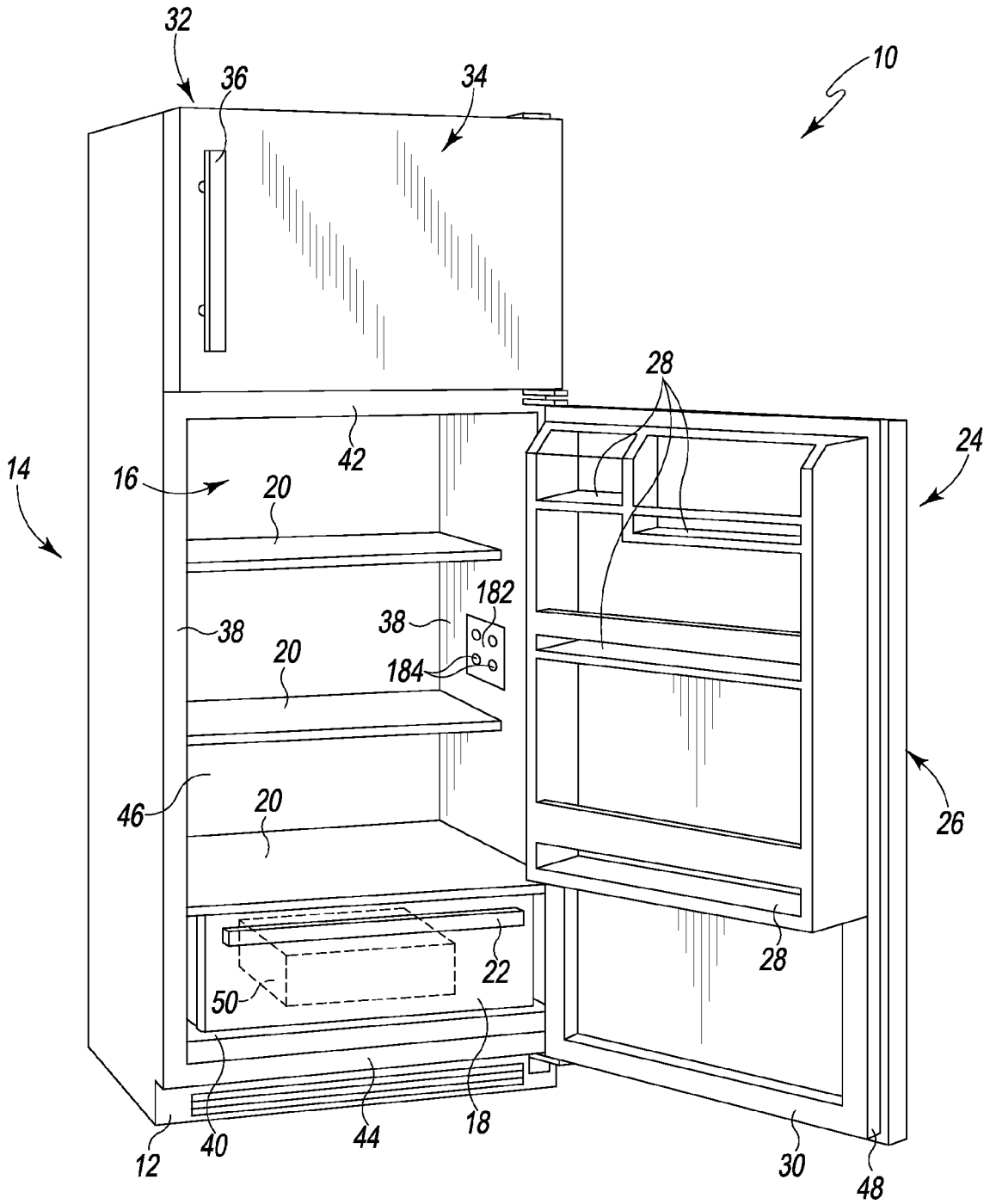
FIG. 1 is a perspective view of a refrigerator including one embodiment of a chilling device.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the disclosure.

Referring to FIG. 1, a home appliance is shown as a refrigerator 10. The refrigerator 10 includes a lower frame 12 and a cabinet 14 extending upwardly from the lower frame 12. The refrigerator cabinet 14 defines a refrigerated compartment 16 into which a user may place and store food items. The refrigerator 10 is operable to maintain stored food items in the refrigerated compartment 16 at a predefined temperature. The refrigerator 10 may also include a number of shelves 20 positioned at various locations within the refrigerated compartment 16.

The refrigerator 10 includes a crisper drawer 18 positioned within the refrigerated compartment 16. As shown in FIG. 1, the crisper drawer 18 is positioned below the number of shelves 20 located in the refrigerated compartment 16. As described in greater detail below, the crisper drawer 18 is configured to extend from and retract into the refrigerated compartment 16 and is shown in a fully retracted position in FIG. 1. The crisper drawer 18 includes a handle 22 that permits the user to extend and retract the crisper drawer 18. The crisper drawer 18 may be constructed of plastics materials formed from polymers, including thermoplastic and thermosetting polymers. Alternatively, the crisper drawer 18 may be constructed of aluminum or steel sheet metal materials. The crisper drawer 18 may possess transparent properties permitting a full view of items stored within crisper drawer 18, opaque properties preventing a full or partial view of items stored within crisper drawer 18, or some variation therebetween permitting a partial view of items stored within crisper drawer 18. As shown in FIG. 1, the crisper drawer 18 possesses transparent properties permitting the view of a chilling device 50 positioned within the crisper drawer 18. As described in greater detail below, the chilling device 50 is operable to rotate food containers placed in drawer 18 by turning or rotating the containers to enhance the cooling of the contents of the food containers.

The refrigerator 10 includes a door 24 hinged to the front of the refrigerator cabinet 14. As shown in FIG. 1, the door 24 is in an open position that permits user access to the refrigerated compartment 16 such that food items may be placed in and retrieved from the refrigerator 10. The door 24 may include a handle (not shown) located on a front panel 26 of the door 24, and the user may use the handle to pull the door 24 open. The door 24 may also include a number of shelves 28 located on a back panel 30 of the door 24 and positioned in the refrigerated compartment 16 when the door 24 is closed.

The refrigerator cabinet 14 also defines a freezer compartment 32 that the refrigerator 10 may independently operate to maintain food items stored therein at a certain temperature. A freezer door 34 hinged to the front of the refrigerator cabinet 14 permits user access to the freezer compartment 32 such that food items may be placed in and retrieved from the refrigerator 10. A handle 36 located on the freezer door 34 permits the user to pull the freezer door 34 open. The freezer compartment 32 is shown positioned above the refrigerated compartment 16 in FIG. 1.

The refrigerator cabinet 14 includes a number of sidewalls 38 that extend upwardly from a bottom wall 40 to a top wall 42, thereby defining the refrigerated compartment 16. The open front side 44 of the refrigerator cabinet 14 defines an access opening 46, which provides user access to the number of shelves 20 located in the refrigerated compartment 16 when the door 24 is open. When the door 24 is closed, an outer edge 48 of the back panel 30 of the door 24 seals the access opening 46, thereby preventing the user from accessing the number of shelves 20 and the crisper drawer 18 located in the refrigerated compartment 16. The door 24 also prevents chilled air from escaping through the access opening 46 of the refrigerator 10.

Figure 2A:
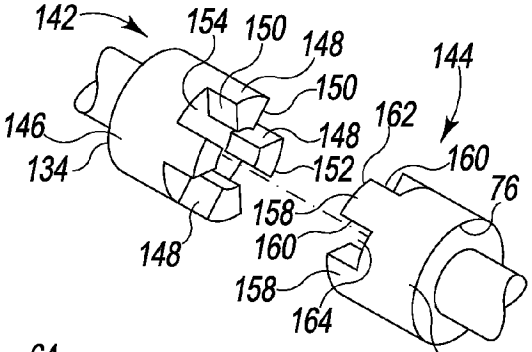
FIG. 2*a* is a perspective view of a coupler of the chilling device of FIG. 2.
Figure 2:
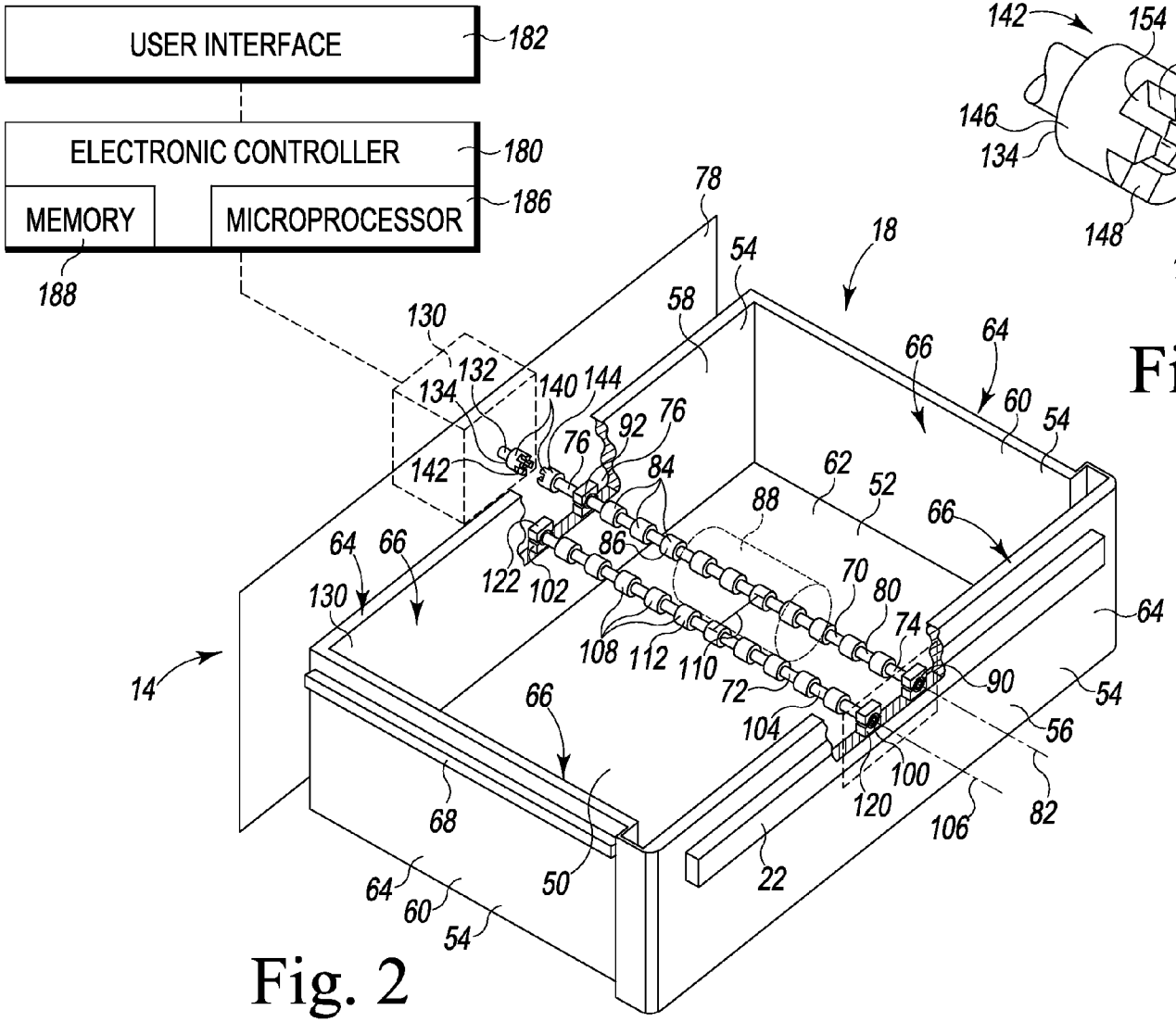
FIG. 2 is a fragmentary perspective view of a drawer of the refrigerator having the chilling device of FIG. 1 positioned therein.

Referring to FIG. 2, the crisper drawer 18 is shown partially extended from the refrigerated compartment 16. The crisper drawer 18 includes a bottom panel 52 and a number of side panels 54 extending upwardly from the bottom panel 52. The side panels 54 include a front wall 56, a rear wall 58, and a pair of side walls 60 connecting the front wall 56 to the rear wall 58. The walls 56, 58, 60 and the bottom panel 52 cooperate to define a storage chamber 62 in the drawer 18.

Each of the walls 56, 58, 60 has an outer surface 64 that faces the sidewalls 38 of the cabinet 14 and an inner surface 66 positioned opposite the outer surface 64. As shown in FIG. 2, the front wall 56 of the crisper drawer 18 has the handle 22 mounted on the outer surface 64 thereof. As described above, the handle 22 may be used to extend and retract the crisper drawer 18. In the illustrative embodiment, the crisper drawer 18 includes a flange 68 that extends outwardly from each outer surface 64. The flange 68 is configured to engage a corresponding guide (not shown) defined in each sidewall 38 of the refrigerator cabinet 14. In that way, the crisper drawer 18 may slide relative to the sidewalls 38 into and out of the refrigerated compartment 16. It should be appreciated that in other embodiments the drawer and the sidewalls of the refrigerator cabinet 14 may include any combination of rollers, rails, and other mechanisms that permit the drawer to move relative to the cabinet.

As described above, the refrigerator 10 includes a chilling device 50 that is positioned within the storage chamber 62 of the crisper drawer 18. The chilling device 50 includes a pair of support shafts 70, 72 that extend between the front wall 56 and the rear wall 58 of the drawer 18. As shown in FIG. 2, the support shaft 70 extends from an end 74 pivotally coupled to the front wall 56 of the drawer 18 to an end 76 positioned between the back wall 78 of the refrigerator cabinet 14. The support shaft 70 has a cylindrical outer surface 80 and a longitudinal axis 82 extending between the ends 74, 76.

A plurality of rollers 84 are secured to the outer surface 80 of the support shaft 70 between the ends 74, 76. As shown in FIG. 2, each of the rollers 84 is cylindrically shaped and spaced apart from one another. The rollers 84 are situated along the support shaft 70 to provide equal spacing between each one of the rollers 84. In the illustrative embodiment, the rollers 84 are axially fixed relative to the support shaft 70. In other embodiments, the rollers 84 may be permitted to rotate relative to the support shaft 70. As described in greater detail below, the outer surfaces 86 of the rollers 84 engage a food container, such as, for example, beverage container 88 when the container 88 is positioned in the chilling device 50.

The end 74 of the support shaft 70 is coupled to the front wall 56 of the drawer 18 via a roller bearing 90. In the illustrative embodiment, the front wall 56 is molded over the bearing 90. The bearing 90 includes an inner and outer race (not shown) and spherically-shaped balls (not shown) that permit the inner race to rotate relative to the outer race. It should be appreciated that in other embodiments the bearing 90 may be a cylindrical roller bearing, a needle roller bearing, a tapered roller bearing, or a spherical roller bearing.

The support shaft 70 of the chilling device 50 is also pivotally coupled to the rear wall 58 of the drawer 18 via a roller bearing 92. In the illustrative embodiment, the rear wall 58 is molded over the bearing 92. The bearing 92 includes an inner and outer race (not shown) and spherically-shaped balls (not shown). It should be appreciated that in other embodiments the bearing 92 may be a cylindrical roller bearing, a needle roller bearing, a tapered roller bearing, or a spherical roller bearing. The bearings 90, 92 cooperate to permit the support shaft 70 to rotate about the longitudinal axis 82, as described in greater detail below. In other embodiments, the chilling device 50 may include a support shaft receiving support from only one roller-type bearing. In still other embodiments, the chilling device 50 may include a support shaft supported by the drawer such that no roller-type bearings are needed.

As described above, the chilling device 50 also includes a support shaft 72. The support shaft 72 extends from an end 100 pivotally coupled to the front wall 56 of the drawer 18 to an end 102 pivotally coupled to the rear wall 58 of the drawer 18. The support shaft 72 has a cylindrical outer surface 104 and a longitudinal axis 106 extending between the ends 100, 102. As shown in FIG. 2, the longitudinal axis 106 of the support shaft 72 extends parallel to the longitudinal axis 82 of the support shaft 70.

A plurality of rollers 108 are secured to the outer surface 104 of the support shaft 72 between the ends 100, 102. As shown in FIG. 2, each of the rollers 108 is cylindrically shaped and spaced apart from one another. In the illustrative embodiment, the rollers 108 are situated along the support shaft 72 to provide equal spacing between each one of the rollers 108. In the illustrative embodiment, the rollers 108 are axially fixed relative to the support shaft 72. In other embodiments, the rollers 108 may be permitted to rotate relative to the support shaft 72. A gap 110 is defined between the outer surfaces 86 of the rollers 84 of the support shaft 70 and the outer surfaces 112 of the rollers 108 of the support shaft 70. As described in greater detail below, the gap 110 forms a carrier slot that is sized such that the container 88 engages the outer surfaces 86, 112 of the rollers 84, 108 when the container 88 is positioned in the chilling device 50.

The end 100 of the support shaft 72 is coupled to the front wall 56 of the drawer 18 via a roller bearing 120. In the illustrative embodiment, the front wall 56 is molded over the bearing 120. The bearing 120 includes an inner and outer race (not shown) and spherically-shaped balls (not shown) that permit the inner race to rotate relative to the outer race. It should be appreciated that in other embodiments the bearing 120 may be a cylindrical roller bearing, a needle roller bearing, a tapered roller bearing, or a spherical roller bearing.

The support shaft 72 of the chilling device 50 is also pivotally coupled to the rear wall 58 of the drawer 18 via a roller bearing 122. In the illustrative embodiment, the rear wall 58 is molded over the bearing 122. The bearing 122 includes an inner and outer race (not shown) and spherically-shaped balls (not shown). It should be appreciated that in other embodiments the bearing 122 may be a cylindrical roller bearing, a needle roller bearing, a tapered roller bearing, or a spherical roller bearing. The bearings 120, 122 cooperate to permit the support shaft 72 to rotate about the longitudinal axis 106, as described in greater detail below. In other embodiments, the chilling device 50 may include a support shaft receiving support from only one roller-type bearing. In still other embodiments, the chilling device 50 may include a support shaft supported by the drawer such that no roller-type bearings are needed.

The refrigerator 10 includes a motor 130 that is coupled to the refrigerator cabinet 14. As described in greater detail below, the motor 130 is configured to actuate the chilling device 50 to rotate food containers positioned thereon. The motor 130 has a drive shaft 132 that extends outwardly from the back wall 78 of the cabinet 14 to an end 134 positioned in the refrigerated compartment 16. When the drawer 18 is positioned as shown in FIG. 2, the end 134 of the drive shaft 132 is located between the back wall 78 of the cabinet 14 and the rear wall 58 of the drawer 18.

As shown in FIG. 2, the refrigerator 10 includes a coupler device 140 configured to connect the drive shaft 132 of the motor 130 to the support shaft 70 of the chilling device 50. In the illustrative embodiment, the coupler device 140 includes a head body 142 formed on the end 134 of the drive shaft 132 and a receiver body 144 formed on the end 76 of the support shaft 70. As shown in FIG. 2*a*, the head body 142 includes a base 146 attached to the end 134 of the drive shaft 132 and a plurality of teeth 148 that extend outwardly from the base 146. In the illustrative embodiment, the base 146 has a generally cylindrical shape, and the teeth 148 are arranged about the circumference of the base 146. Each tooth 148 includes a pair of angled side surfaces 150 that extend away from the base 146 to an outer end 152. A plurality of voids 154 are defined between the side surfaces 150 of the teeth 148.

The receiver body 144 of the support shaft 70 also includes a base 156 attached to the end 76 and a plurality of teeth 158 that extend outwardly from the base 156. In the illustrative embodiment, the base 156 has a generally cylindrical shape, and the teeth 158 are arranged about the circumference of the base 156. Each tooth 158 includes a pair of angled side surfaces 160 that extend away from the base 156 to an outer end 162. A plurality of voids 164 are defined between the side surfaces 160 of the teeth 148.

When the drawer 18 is retracted into the refrigerated compartment 16, the head body 142 of the drive shaft 132 is configured to mate with the receiver body 144 of the support shaft 70. The teeth 158 of the receiver body 144 are received in the voids 154 defined in the head body 142 of the drive shaft 132. Similarly, the teeth 148 of the head body 142 are received in the voids 164 defined in the receiver body 144 of the support shaft 70. Each of the angled side surfaces 150 of the head body 142 is arranged to confront and mate with a corresponding angled side surface 160 of the receiver body 144. As described in greater detail below, the mating of the bodies 142, 144 permits the motor 130 to impart rotational motion to the support shaft 70, thereby causing the support shaft 70 to rotate about the longitudinal axis 82.

As shown in FIG. 2, the refrigerator 10 also includes an electronic controller 180 that is electrically coupled to the motor 130 and a user interface 182 electrically coupled to the controller 180. The user interface 182 includes a number of controls 184 (see FIG. 1) that permit the user to operate the chilling device 50. In the illustrative embodiment, the user interface 182 is located on one of the sidewalls 38 of the refrigerator cabinet 14. It should be appreciated that in other embodiments the user interface 182 may be positioned on the door 24 or in another location on the external surface of the refrigerator 10.

The controller 180 includes a number of electronic components commonly associated with electronic units which are utilized in the control of electromechanical systems. For example, the controller 180 may include, amongst other components customarily included in such devices, a processor such as a microprocessor 186 and a memory device 188 such as a programmable read-only memory device ("PROM") including erasable PROM's (EPROM's or EEPROM's). The memory device 188 is provided to store, amongst other things, instructions in the form of, for example, a software routine (or routines) which, when executed by the processor, allows the controller 180 to control operation of the chilling device 50.

Figure 3:
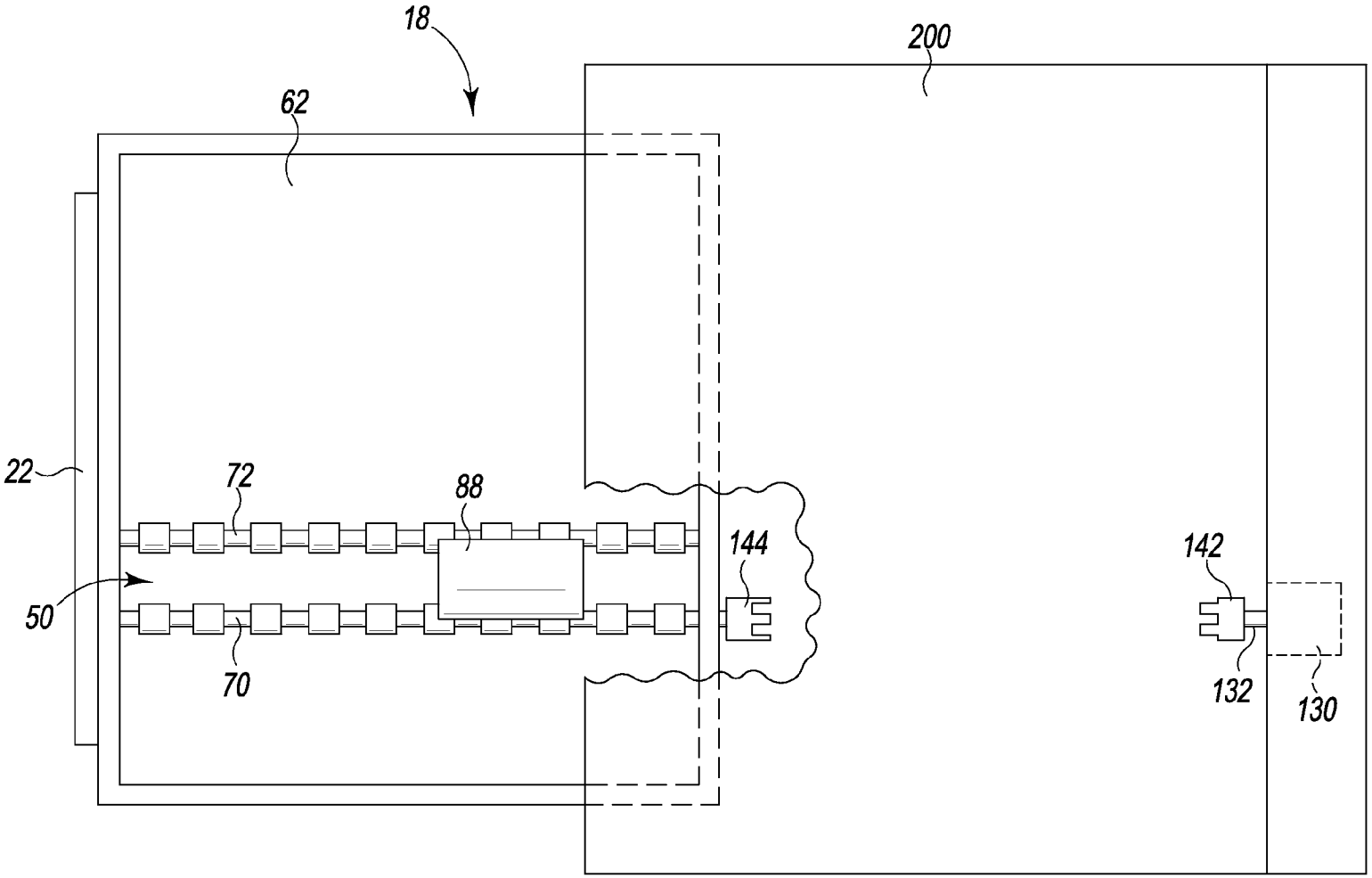
FIG. 3 is a top plan view of the chilling device of FIGS. 1 and 2 with the drawer in an open position.

Referring now to FIG. 3, the crisper drawer 18 may be positioned in an open position that permits access the storage chamber 62 In the open position, the drawer 18 extends outwardly from below a shelf 200 of the refrigerator 10 such that the user may access food items in the storage chamber 62 and the chilling device 50. A user may position a beverage container 88 in the chilling device 50 to assist with the cooling of the beverage container 88. As discussed above, the gap or carrier slot 110 is sized such that the container 88 engages the outer surfaces 86, 112 of the rollers 84, 108 when the container 88 is positioned in the chilling device 50. In that way, the beverage container 88 is supported by the rollers 84, 108 on the support shafts 70, 72, respectively.

As shown in FIG. 3, the support shaft 70 is disengaged from the motor drive shaft 132 when the crisper drawer 18 is in the open position. The receiver body 144 of the support shaft 70 is spaced apart from the head body 142 such that the operation of the motor 130 does not actuate the chilling device 50 to rotate any beverage containers 88 positioned thereon. It should be appreciated the refrigerator 10 may include sensors, switches, or other devices configured to generate an electric signal indicating the position of the crisper drawer 18. The electronic controller 180 may be configured to receive that signal and deactivate the motor 130 such that the user cannot operate the motor 130 while the crisper drawer 18 is in the open position.

Figure 4:
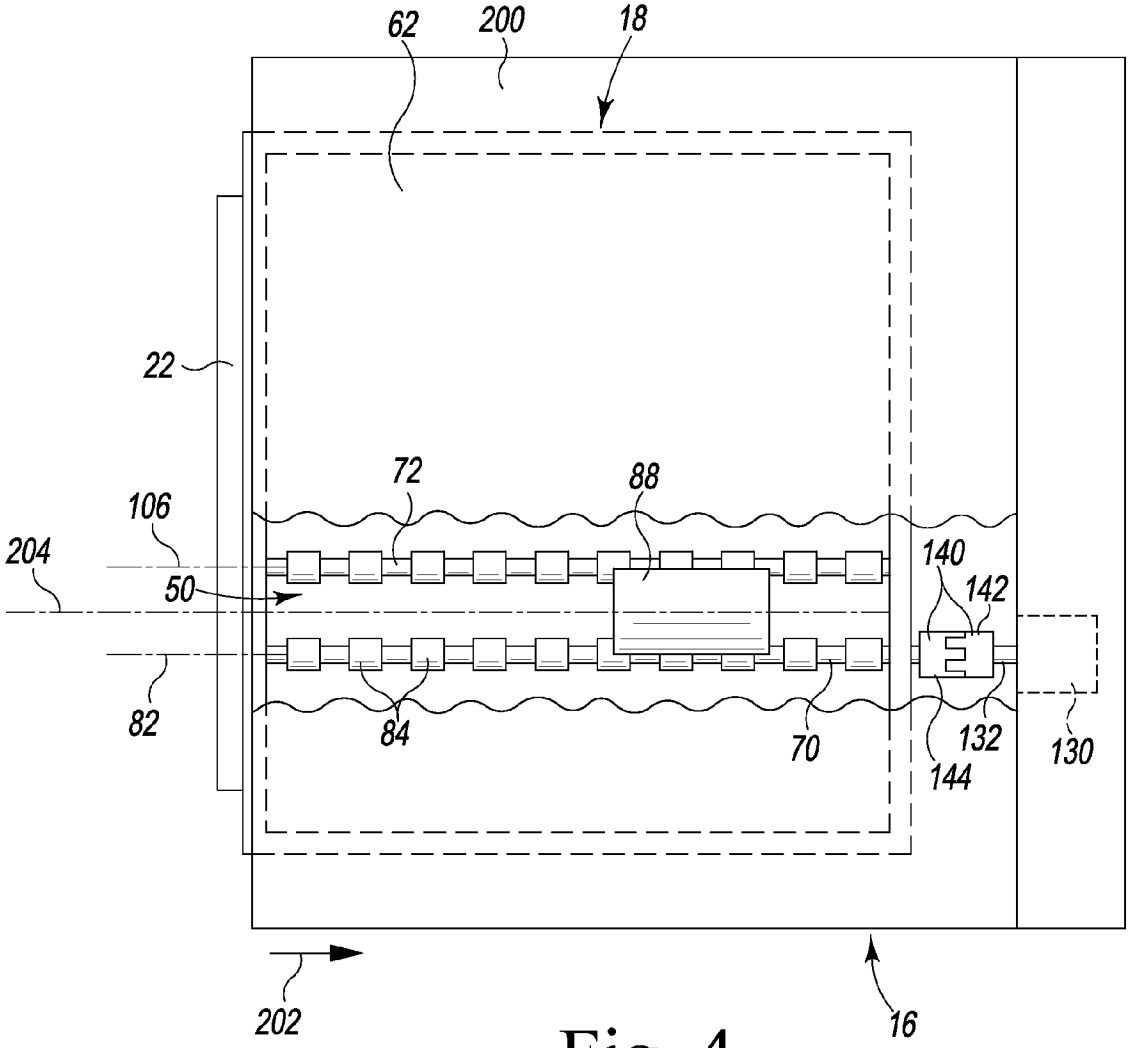
FIG. 4 is a view similar to FIG. 3 showing the drawer in a closed position.

After a user has positioned one or more containers 88 on the chilling device 50, the user may move the crisper drawer 18 from the open position to the closed position shown in FIG. 4. To do so, the user may grasp the handle 22 and push in the direction indicated by arrow 202. When the crisper drawer 18 is in the closed position shown in FIG. 4, the shelf 200 prevents access to the container 88 and other food items located in the storage chamber 62. It should be appreciated that in other embodiments the refrigerator 10 may include a locking mechanism configured to engage the crisper drawer 18 and maintain the crisper drawer 18 in the closed position.

As shown in FIG. 4, the drawer 18 is retracted into refrigerated compartment 16 such that the head body 142 of the motor drive shaft 132 is mated with the receiver body 144 of the support shaft 70. The teeth 158 of the receiver body 144 are received in the voids 154 defined in the head body 142 of the motor drive shaft 132. Similarly, the teeth 148 of the head body 142 are received in the voids 164 defined in the receiver body 144 of the support shaft 70. In that way, rotational motion of the motor drive shaft 132 may be imparted to the support shaft 70.

When the drawer 18 is in the closed position, the user may operate the controls 184 of the user interface 182 to activate the chilling device 50. In the illustrative embodiment, the user may adjust and/or control the speed, duration, or other operating parameters of the chilling device 50 through the user interface 182. When activated, the motor 130 rotates the drive shaft 132. As described above, the coupler device 140 connects the support shaft 70 to the drive shaft 132 such that the support shaft 70 is rotated about the longitudinal axis 82. As the support shaft 70 is rotated about the longitudinal axis 82, the engagement between the rollers 84 and the beverage container 88 causes the beverage container 88 to rotate about a longitudinal axis 204. The other support shaft 72 is also rotated about its longitudinal axis 106 with the beverage container 88, thereby assisting with the rotation of the beverage container 88. As the beverage container 88 is rotated about the axis 204, the fluid contents of the container 88 are placed in motion, thereby assisting in lowering the temperature of the contents.

It should be appreciated that in other embodiments the chilling device may include, for example, a fan or other device for directing cooling air over the container 88 to further assist in lowering the temperature of the contents of the container 88. It should also be appreciated that in other embodiments the chilling device 50 may be attached to a shelf 20 or may be positioned in the door 24 of the refrigerator 10.

Figure 5:
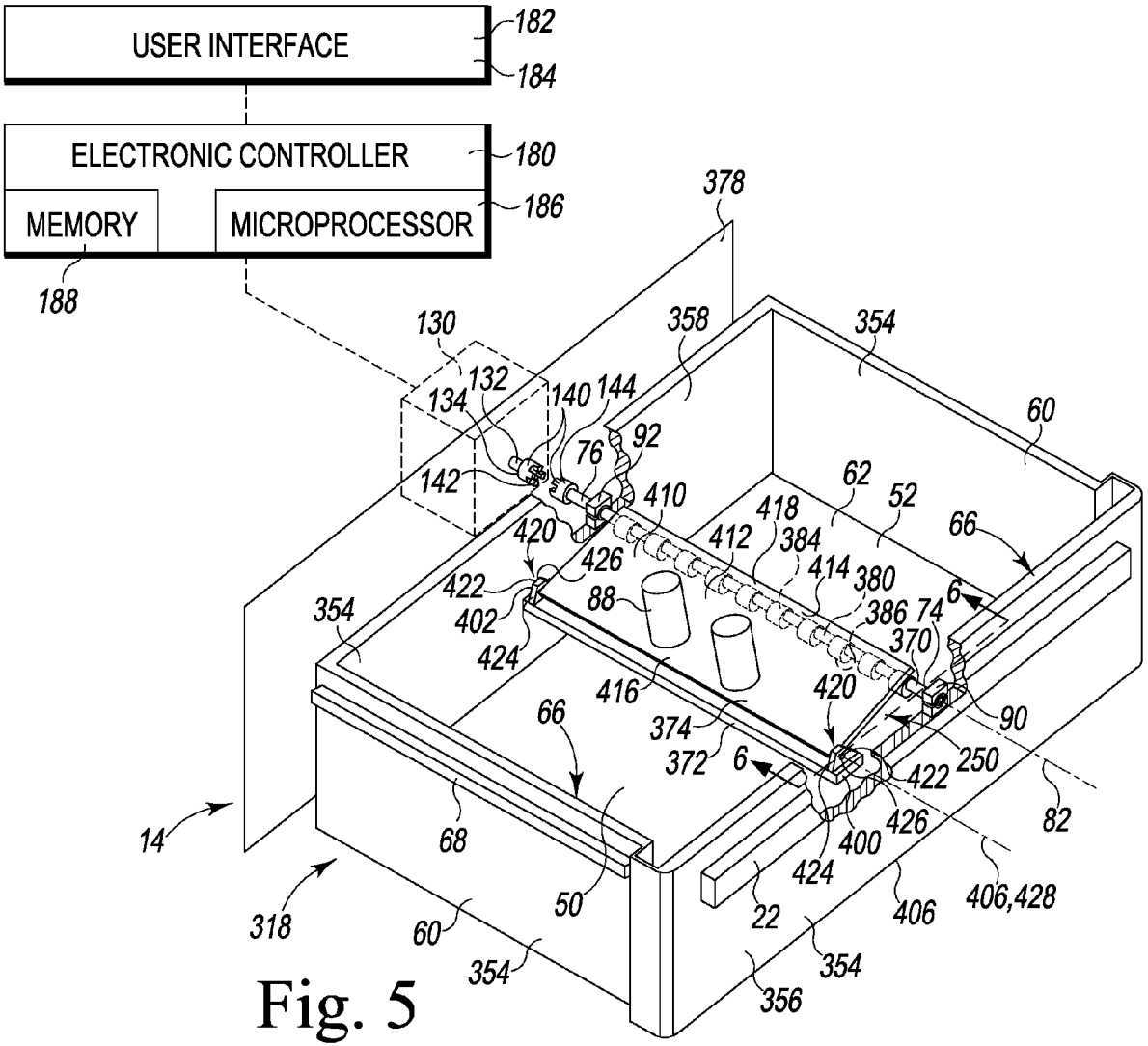
FIG. 5 is a fragmentary perspective view of the drawer of the refrigerator having another embodiment of the chilling device positioned therein.
Figure 6:
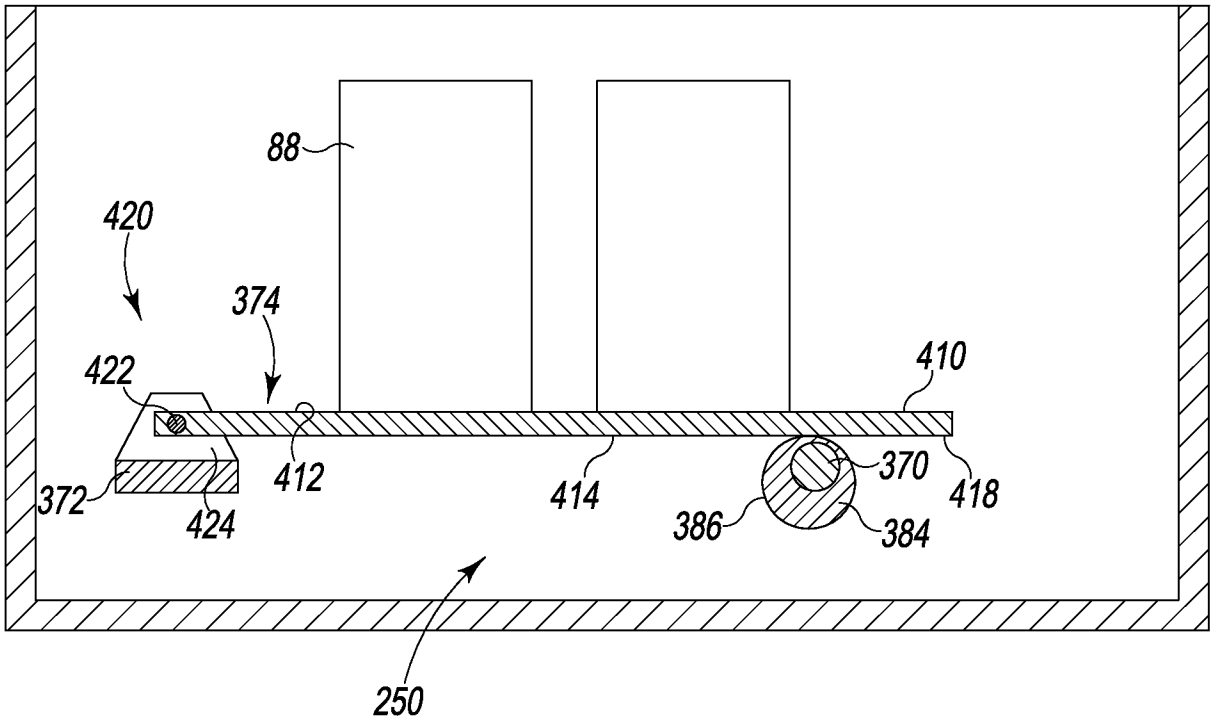
FIG. 6 is a cross-sectional front elevation view of the chilling device of FIG. 5 showing a cam of the chilling device in one position.
Figure 7:
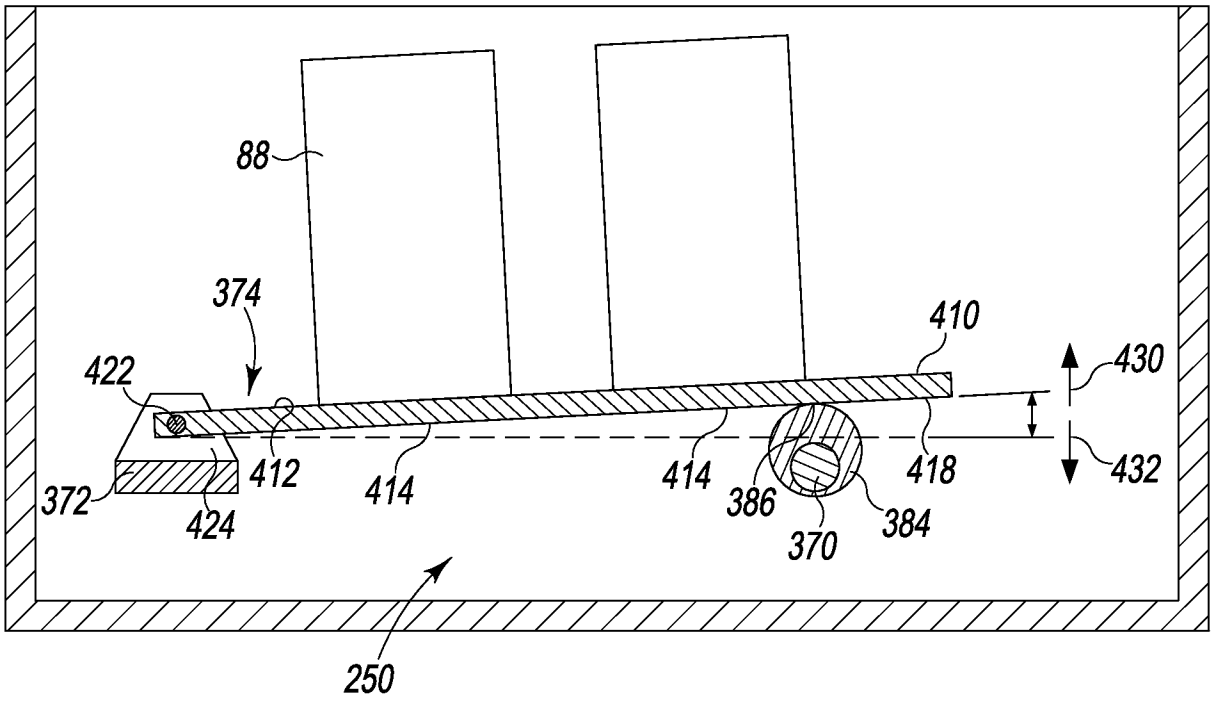
FIG. 7 is view similar to FIG. 6 showing the cam of the chilling device in another position.

Referring now to FIGS. 5-7, another embodiment of a chilling device (hereinafter chilling device 250) for the refrigerator 10 is illustrated. Some features of the embodiment illustrated in FIGS. 5-7 are substantially similar to those discussed above in reference to the embodiment of FIGS. 1-4. Such features are designated in FIGS. 5-7 with the same reference numbers as those used in FIGS. 1-4.

Referring to FIG. 5, a crisper drawer 318 is shown partially extended from the refrigerated compartment 16. The crisper drawer 318 includes a bottom panel 52 and a number of side panels 354 extending upwardly from the bottom panel 52. The side panels 354 include a front wall 356, a rear wall 358, and a pair of side walls 60 connecting the front wall 356 to the rear wall 358. The walls 356, 358, 60 and the bottom panel 52 cooperate to define a storage chamber 62 in the drawer 18.

The chilling device 250 is positioned in the storage chamber 62 of the crisper drawer 318. The chilling device 250 includes a pair of support shafts 370, 372 that extend between the front wall 356 and the rear wall 358 of the drawer 318 and a food container tray 374 pivotally coupled to the support shaft 372. As shown in FIG. 5, the support shaft 370 extends from an end 74 pivotally coupled to the front wall 356 of the drawer 18 to an end 76 positioned between the back wall 378 of the refrigerator cabinet 14. The support shaft 370 has a cylindrical outer surface 380 and a longitudinal axis 82 extending between the ends 74, 76.

A plurality of cams 384 are secured to the outer surface 380 of the support shaft 370 between the ends 74, 76. As shown in FIG. 6, each of the cams 384 is elliptically shaped and spaced apart from one another. The cams 384 are situated along the support shaft 370 to provide equal spacing between each one of the cams 384. In the illustrative embodiment, the cams 384 are axially fixed relative to the support shaft 370. As described in greater detail below, each cam 384 has a cam surface 386 that engages the container tray 374.

Like the support shaft 70 described above in regard to FIGS. 1-4, the end 74 of the support shaft 370 is coupled to the front wall 356 of the drawer 318 via a roller bearing 90. The support shaft 370 of the chilling device 250 is also pivotally coupled to the rear wall 358 of the drawer 318 via a roller bearing 92. In the illustrative embodiment, the front wall 356 is molded over the bearing 90, and the rear wall 358 is molded over the bearing 92. The bearings 90, 92 include an inner and outer race (not shown) and spherically-shaped balls (not shown). It should be appreciated that in other embodiments the bearings 90, 92 may be cylindrical roller bearings, a needle roller bearings, a tapered roller bearings, or a spherical roller bearings. The bearings 90, 92 cooperate to permit the support shaft 370 to rotate about the longitudinal axis 82, as described in greater detail below.

As described above, the chilling device 250 also includes a support shaft 372. The support shaft 372 extends from an end 400 secured to the front wall 356 of the drawer 318 to an end 402 secured to the rear wall 358 of the drawer 318. The support shaft 372 has a longitudinal axis 406 extending between the ends 400, 402. As shown in FIG. 2, the longitudinal axis 406 of the support shaft 372 extends parallel to the longitudinal axis 82 of the support shaft 370.

The chilling device 250 also includes a food container tray 374 pivotally coupled to the support shaft 372. As shown in FIG. 5, the tray 374 includes a plate 410 that has an upper surface 412 and a lower surface 414 positioned opposite the upper surface 412. The end 416 of the plate 410 is attached to the support shaft 372. At the opposite end 418 of the plate 410, the lower surface 414 of the plate 410 engages the cams 384 of the outer support shaft 372. As shown in FIG. 5, the upper surface 412 of the plate 410 is substantially planar. It should be appreciated that in other embodiments the plate 410 may include indentations or slots to position and support containers 88 positioned thereon. It should also be appreciated that in other embodiments the tray 374 may include a side wall formed around the outer perimeter of the plate.

The container tray 374 of the chilling device 250 is connected to the support shaft 372 via a pair of pivot joints 420. Each pivot joint 420 includes a cylindrical pin 422 extending outwardly from the plate 410 and a mounting bracket 424 extending upwardly from the support shaft 372. Each mounting bracket 424 has a through-hole 426 defined therein. Each pin 422 is received in a corresponding through-hole 426, thereby securing the container tray 374 to the support shaft 372. The pins 422 define a pivot axis 428 of the container tray 374. It should be appreciated that the container tray 374 may be removable from the support shaft 372. For example, the tray 374 may include a locking mechanism that selectively extends and retracts the pins 422 from engagement with the mounting bracket 424.

As shown in FIG. 5, the refrigerator 10 includes a coupler device 140 configured to connect the drive shaft 132 of the motor 130 to the support shaft 370 of the chilling device 250. In the illustrative embodiment, the coupler device 140 includes a head body 142 formed on the end 134 of the drive shaft 132 and a receiver body 144 formed on the end 76 of the support shaft 370. When the drawer 318 is retracted into the refrigerated compartment 16, the head body 142 of the drive shaft 132 is configured to mate with the receiver body 144 of the support shaft 370 in a manner similar to that described above in regard to FIGS. 1-4 such that the support shaft 370 may be rotated about the longitudinal axis 82.

In use, the crisper drawer 318 may be moved between an open position and a closed position. Like the embodiment of FIGS. 1-4, the support shaft 370 is disengaged from the motor drive shaft 132 when the crisper drawer 318 is in the open position. In the open position, the user may position a beverage container 88 in the chilling device 250 to assist with the cooling of the beverage container 88. After the user has positioned one or more containers 88 on the chilling device 250, the user may move the crisper drawer 318 from the open position to the closed position. When in the closed position, the drawer 318 is retracted into refrigerated compartment 16 such that the head body 142 of the motor drive shaft 132 is mated with the receiver body 144 of the support shaft 370.

The user may operate the controls 184 of the user interface 182 to activate the chilling device 250. In the illustrative embodiment, the user may adjust and/or control the speed, duration, or other operating parameters of the chilling device 250 through the user interface 182. When activated, the motor 130 rotates the drive shaft 132. The coupler device 140 connects the support shaft 370 to the drive shaft 132 such that the support shaft 370 is rotated about the longitudinal axis 82. As the support shaft 370 is rotated about the longitudinal axis 82, the engagement between the cams 384 and the container tray 374 raises and lowers the end 418 of the container tray 374 in the direction indicated by arrows 430, 432. As the container tray 374 is raised and lowered, the fluid contents of the container 88 that are positioned on the tray 374 are placed in motion, thereby assisting in lowering the temperature of the contents.

There are a plurality of advantages of the present disclosure arising from the various features of the method, apparatus, and system described herein. It will be noted that alternative embodiments of the method, apparatus, and system of the present disclosure may not include all of the features described yet still benefit from at least some of the advantages of such features. Those of ordinary skill in the art may readily devise their own implementations of the method, apparatus, and system that incorporate one or more of the features of the present invention and fall within the spirit and scope of the present disclosure.

The invention claimed is:

1. A refrigerator comprising:

a cabinet having a refrigerated compartment defined therein, wherein the cabinet has a back wall defined between a front side and a back side;

a motor coupled to the back side of the back wall of the cabinet, the motor having a drive shaft that extends through the back wall into the refrigerated compartment, a drawer positioned in the refrigerated compartment, the drawer having a storage chamber defined therein, the drawer includes a bottom wall, a front wall, a rear wall, and a plurality of side walls that define the storage chamber, and a chilling device comprising a support shaft positioned in the storage chamber of the drawer, wherein the support shaft comprises a longitudinal axis and the support shaft is rotationally coupled to the front wall and the rear wall, wherein the support shaft extends through the rear wall of the drawer, wherein the drawer is moveable between an open position in which user access to the storage chamber is permitted and the chilling device is spaced apart from the drive shaft and a closed position in which user access to the storage chamber is prevented and the chilling device is coupled to the drive shaft, and the drive shaft is configured to operate the chilling device when the drawer is in the closed position wherein the chilling device includes a plurality of cams that are coupled to the support shaft, wherein the chilling device includes: a support arm extending from one of the side walls of the drawer, and a plate defining a storage tray sized to receive a food container, the plate having a first end pivotally coupled to the support arm and a second end in contact with the plurality of cams of the support shaft.

2. The refrigerator of claim 1, wherein the chilling device includes a coupler configured to engage with the drive shaft when the drawer is in the closed position.

3. The refrigerator of claim 2, wherein the coupler includes:

a first body having a vertically-extending surface and a plurality of teeth extending outwardly from the vertically-extending surface, and a second body secured to the drive shaft, the second body having a vertically-extending surface that faces the vertically-extending surface of the first body and a plurality of teeth that engage the plurality of teeth of the first body when the drawer is in the closed position.

4. The refrigerator of claim 1, wherein:

when the drawer is in the closed position, the drive shaft is engaged with the support shaft to rotate the support shaft about a longitudinal axis.

5. The refrigerator of claim 1, wherein the plurality of cams raise and lower the second end of the plate when the support shaft is rotated about the longitudinal axis.

6. A chilling device for a refrigerator comprising:

a housing of a refrigerator, the housing having a fresh food compartment and a freezer compartment, a motor secured to an exterior of the housing of the fresh food compartment, a frame movably coupled to the housing of the fresh food compartment, a first shaft pivotally coupled to the frame, and wherein the frame is moveable between a first position in which the first shaft is connected to the motor, and a second position in which the first shaft is spaced apart from the motor, and wherein the frame, and the first shaft are disposed within the fresh food compartment wherein the chilling device includes a plurality of cams that are coupled to the first shaft, wherein the chilling device includes: a support arm extending from a side wall of the frame, and a plate defining a storage tray sized to receive a food container, the plate having a first end and pivotally coupled to the support arm and a second end in contact with the plurality of cams of the first shaft.

7. The chilling device of claim 6, wherein the frame is a drawer having a storage chamber defined therein.

8. The chilling device of claim 6, wherein:

the motor includes a drive shaft having a first plurality of teeth formed thereon, and the first shaft has a second plurality of teeth formed thereon, the second plurality of teeth being engaged with the first plurality of teeth when the frame is in the first position, and spaced apart from the first plurality of teeth when the frame is in the second position.

9. A chilling device for a refrigerator comprising:

a refrigerator cabinet, a refrigerator shell within the refrigerator cabinet, a refrigerated compartment within the refrigerator shell, a motor disposed between the refrigerator cabinet and the refrigerator shell, the motor having a drive shaft that extends through the refrigerator shell into the refrigerated compartment, a frame movably coupled to the refrigerator shell, the frame having a rear wall;

a shaft pivotally coupled to the frame and extending through the rear wall of the frame a plurality of cams coupled to the shaft, and a plate defining a storage tray sized to receive a food container, the plate having a first end pivotally coupled to the frame and a second end engaged with the plurality of cams, wherein the frame is moveable between a first position in which the shaft is connected to the drive shaft of the motor, and a second position in which the shaft is spaced apart from the drive shaft of the motor, and wherein the frame, the shaft, and the plate are disposed within the refrigerated compartment.

10. The chilling device of claim 9, wherein the frame includes a support arm extending parallel to the shaft, and the first end of the plate is pivotally coupled to the support arm.

11. The chilling device for a refrigerator of claim 9, wherein the frame is a drawer having a storage chamber defined therein.

12. The chilling device of claim 9, wherein:

the motor includes a drive shaft having a first plurality of teeth formed thereon, and the shaft has a second plurality of teeth formed thereon, the second plurality of teeth being engaged with the first plurality of teeth when the frame is in the first position, and spaced apart from the first plurality of teeth when the frame is in the second position.

13. The chilling device of claim 9, wherein the motor is operable to rotate the shaft about a longitudinal axis when the shaft is connected to the motor, and the plurality of cams raise and lower the second end of the plate when the shaft is rotated about the longitudinal axis.

* * * * *